US005678704A

United States Patent [19]

Deeds

[11] Patent Number: 5,678,704

[45] Date of Patent: Oct. 21, 1997

[54] CURTAIN SUPPORT MEMBER AND MOUNTING APPARATUS FOR A CURVE ARCHWAY

[76] Inventor: Diane S. Deeds, 4339 Lakeshore Forest Dr., Missouri City, Tex. 77459

[21] Appl. No.: 650,170

[22] Filed: May 20, 1996

[51] Int. Cl.[6] ..... E04B 1/00

[52] U.S. Cl. ..... 211/105.1; 211/105.2; 160/330

[58] Field of Search ..... 211/105.1, 105.2, 211/123; 160/330, 354, 368.1, 84.07, 134

[56] References Cited

U.S. PATENT DOCUMENTS

| | | | |
|---|---|---|---|
| 4,825,611 | 5/1989 | Bassett | 211/105.3 X |
| 5,044,418 | 9/1991 | Donahue | 160/330 |
| 5,063,985 | 11/1991 | Bozzo | 160/330 |
| 5,205,337 | 4/1993 | Bozzo | 160/330 X |
| 5,219,407 | 6/1993 | Herring | 160/330 |
| 5,407,162 | 4/1995 | Manger | 160/330 X |

*Primary Examiner*—Robert W. Gibson, Jr.
*Attorney, Agent, or Firm*—Kenneth D. Baugh

[57] ABSTRACT

A curtain support member 10 for supporting a curtain 12 in a curved window archway 14 is provided. The curtain support member 10 includes a planar shaped base member 16. The planar shaped base member 16 is provided with a substantially flat lower portion 20 having an elongated channel 22 formed therein. The support member 10 is also provided with a first side member 24 which is coupled to an outermost portion of the base member 16 to project therefrom in a vertical direction a first predetermined distance. A second side member 38 is coupled to another outermost portion of the base member 16 to project therefrom in a diagonal direction a second predetermined distance. The curtain support member 10 is also provided with an upper member 46 which is coupled to the first side member 24 to extend diagonally downwardly into coupling engagement with the second side member 38. Additionally a curtain mounting apparatus 70 is provided for coupling the support member 10 in a curved window archway 14 to selected predetermined portions of the archway so that the support member is coupled therein to conform to the curved configuration of the archway.

13 Claims, 5 Drawing Sheets

CURTAIN SUPPORT MEMBER AND MOUNTING APPARATUS FOR A CURVE ARCHWAY

TECHNICAL FIELD

This invention relates to curtain and drapery supporting and mounting devices and more particularly to a mounting apparatus for hanging curtains in curved shaped window archways. For as long as we can remember curtains have served as decorative accessories for windows as well as a means for achieving privacy. The popularity and practicality of curtains for these purposes are very well known. There are of course all shapes and sizes of windows. Accordingly there is a need to have curtains that can accommodate these varied shapes and sizes of windows. The rectangular shaped window is probably the most common shaped window. Normally the shape or size of this window doesn't present much of a problem for providing supporting devices to hang curtains or draperies on this type window. There are all sorts of efficient practical and inexpensive apparatuses for this purpose.

The curved shaped window archways, on the other hand present a totally different set of concerns. One concern that has to be addressed is created by the need to accomodate the two mounting configurations commonly desired when hanging curtains or draperies in curved shaped window archways. There are users who prefer the aesthetic effect that can be achieved by mounting a curtain inside the arch of the curved window archway. This is commonly referred to as an inside mounted drapery configuration. There are others on the other hand who prefer the aesthetic effects which can be achieved by mounting a curtain adjacent to and outside the arch of the curved window archway. This is commonly referred to as an outside mounted drapery configuration. To address this concern it is desirable that there be a single support and mounting device that can provide for both mounting configurations.

Another concern that has to be addressed when hanging curtains or draperies in curved shaped window archways is related to the size of the window. The size of the window of course dictates the size of the curtains or draperies that will be needed. There are a number of support and mounting devices for use with small curved shaped window archways. However, with regard to the smaller window archways normally there isn't a single apparatus that can be used for both mounting configurations. Additionally, these devices cannot accommodate the larger windows which require the larger and heavier curtains and draperies.

More and more there is a need for a single mounting apparatus that can be readily used to facilitate both mounting configurations while also being readily usable in curved shaped window archways which require large and sometimes heavier curtains and draperies.

To date a large number of the mounting devices that are used for the larger arched shaped windows must be custom built and installed by professionals in order to get a professional and asthetically pleasing result. of course this can be expensive. Some users prefer the professionally installed device.

However there are others who would prefer a support and mounting device that can be used to hang larger curtains and draperies in either mounting configuration while also being readily self installable and while also achieving a professional and asthetically pleasing result.

Accordingly, such a mounting device is desirable and needed.

BACKGROUND OF THE ART

Attempts have been made to provide arched shaped window mounting apparatus. One such apparatus is disclosed in U.S. Pat. No. 5,407,162. This mounting assembly is provided with separate tubular elbows each mountable on an upright surface below an arch of an arched window. Additionally a plastic tube is detachably mounted to the elbows at opposite ends thereof. An intermediate portion of the plastic tube is bent into a bow shape to conform to the shape of the arched window frame. This apparatus attempts to satisfy the desire of many users to have a do it yourself kit. However, this apparatus is a device to hang a curtain in only an inside mounted configuration. Additionally this device may not be readily used to accommodate those arched shaped windows where larger and/or heavier curtains and draperies are required.

Another arrangement is disclosed in U.S. Pat. No. 4,825,611. The rod assembly of this invention is one to be used in arched shaped windows. The traverse rod portions of this assembly is a flexible telescopic rod formed from tube sections of synthetic plastic material. The rod is supported inside the upper boundary of the window aperture by a plurality of hooks which aid in maintaining the rod in a desired orientation.

This arrangement is suitable for users that desire a single small curtain hung inside the arch of the window. This arrangement is not provided to facilitate an outside mounted curtain configuration nor can it accommodate the larger heavier curtains needed for larger windows.

DISCLOSURE OF THE INVENTION

A flexible curtain support member for supporting a curtain in a curved shaped window archway in accordance with the principles of this invention is provided. The curtain support member includes a planar shaped base member having a substantially flat lower portion. The support member is also provided with a first side member which is coupled to an outermost portion of the base member to project vertically from the base member a first predetermined distance. A second side member is coupled to another outermost portion of the base member to project diagonally upwardly from the base member a second predetermined distance which is equal to the first predetermined distance. The curtain support member is also provided with an upper member which is coupled to the first side member adjacent to and in coupling engagement with the base member to extend diagonally downwardly into coupling engagement with the second side member.

Additionally in accordance with the principles of this invention a curtain support member and mounting apparatus is provided for supporting the support member in a curved window archway which includes a means for coupling the base member to selected predetermined portions of the archway so that the support member is coupled therein to conform to the curved configuration of the archway.

BRIEF DESCRIPTION OF THE INVENTION

The details of the invention will be described in connection with the accompanying drawing in which.

BEST MODE FOR CARRYING OUT THE INVENTION

Figure 1:
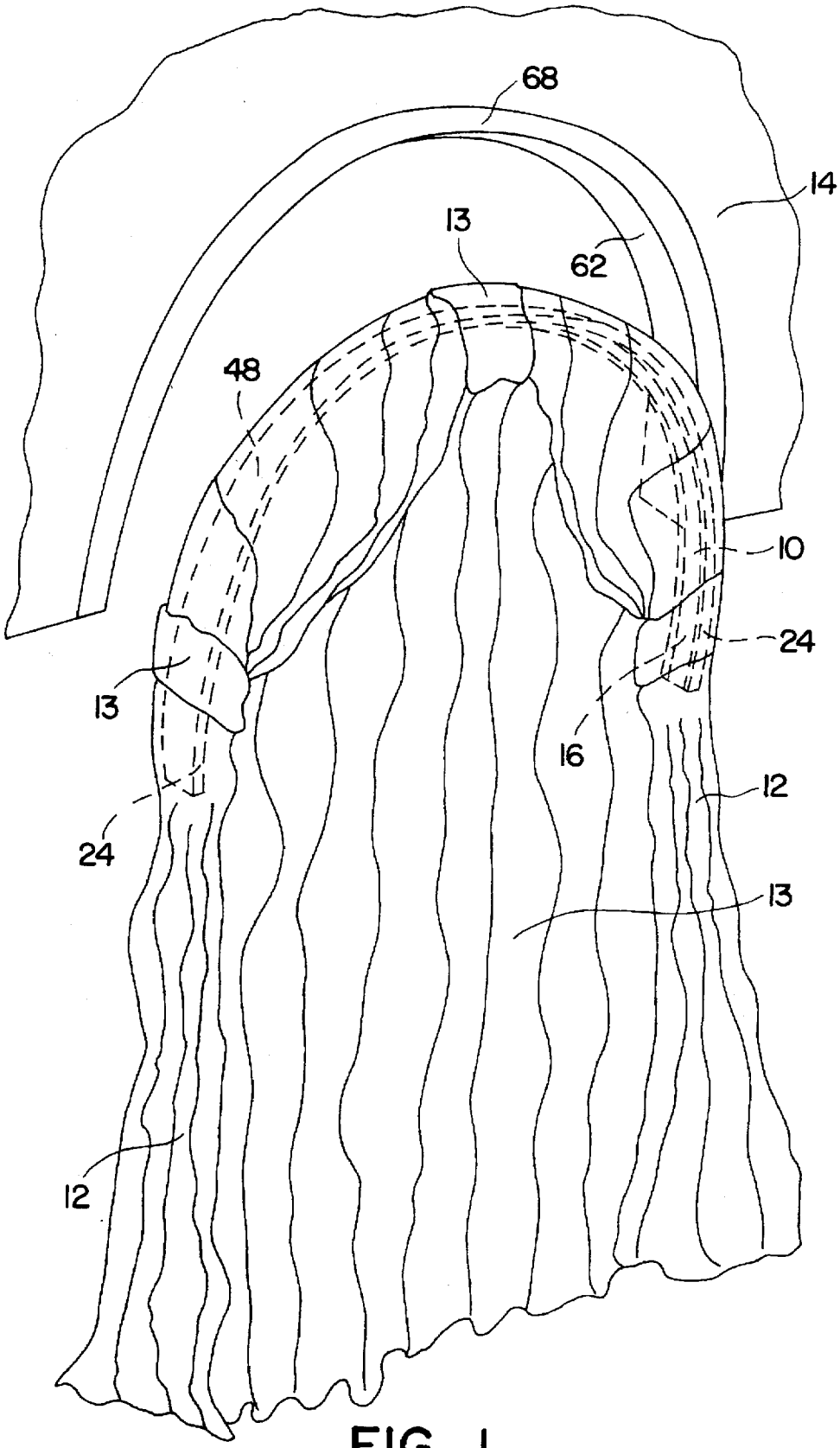
FIG. 1 is a perspective view of a curtain support member and curtain illustrated in conjunction with a curved window archway in accordance with the principles of the invention.
Figure 2:
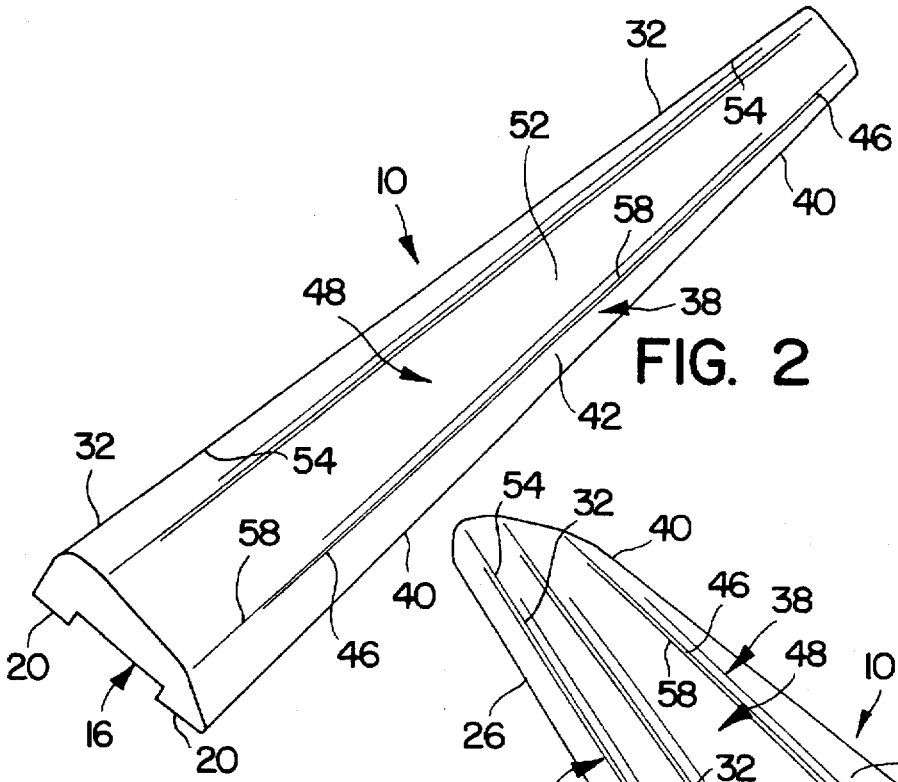
FIG. 2 is a perspective view illustrating a curtain support member in accordance with the principles of this invention.
Figure 3:
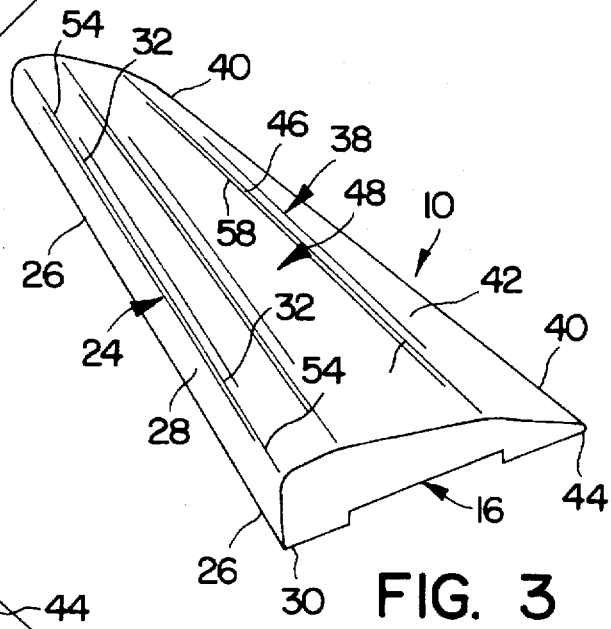
FIG. 3 is second perspective view illustrating the curtain support member in accordance with the principles of the invention.
Figure 4:
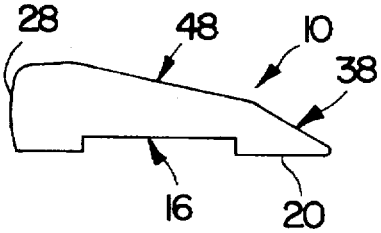
FIG. 4 is a side view of the curtain support member in accordance with the principles of this invention.
Figure 5:
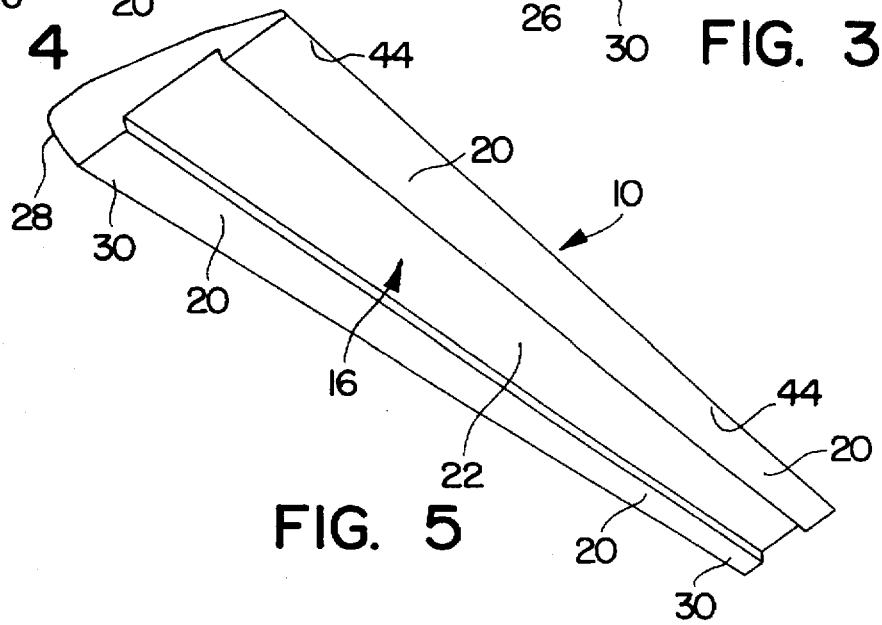
FIG. 5 is a bottom view of a curtain support member in accordance with the principles of this invention.
Figure 6D:
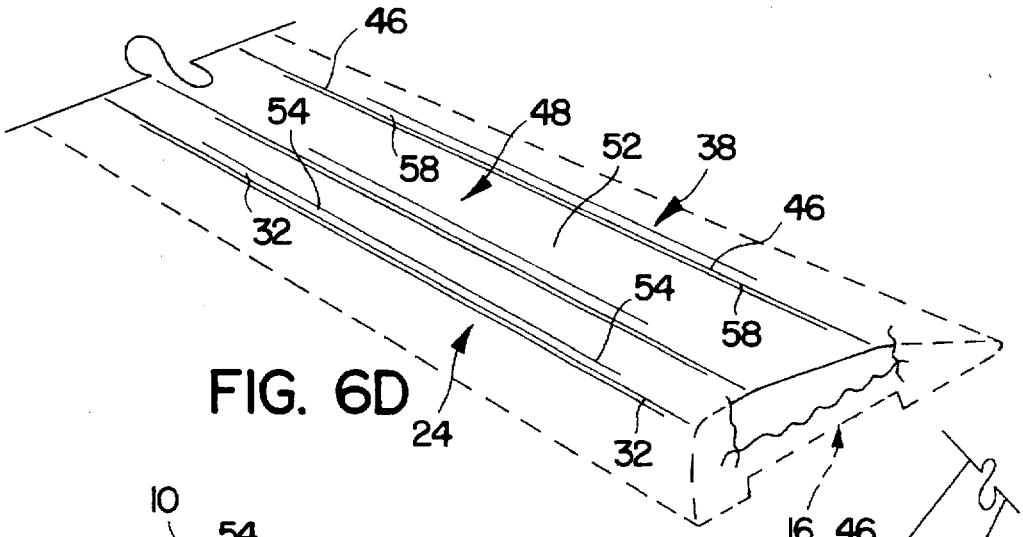
FIGS. 6, 6A–6D are is a fragmented exploded views of the various portions of a curtain support member in accordance with the principles of the invention.
Figure 6:
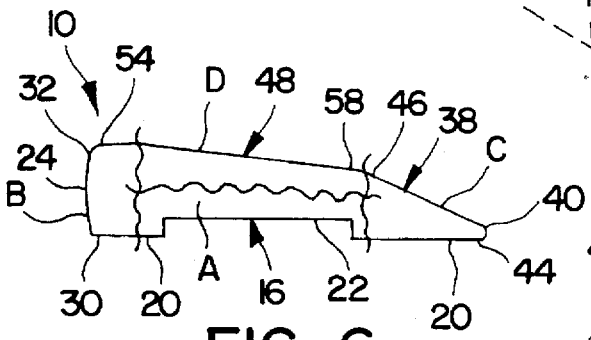
Figure 6B:
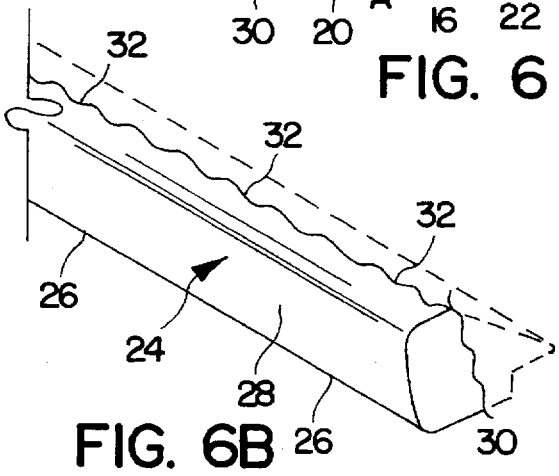
Figure 6C:
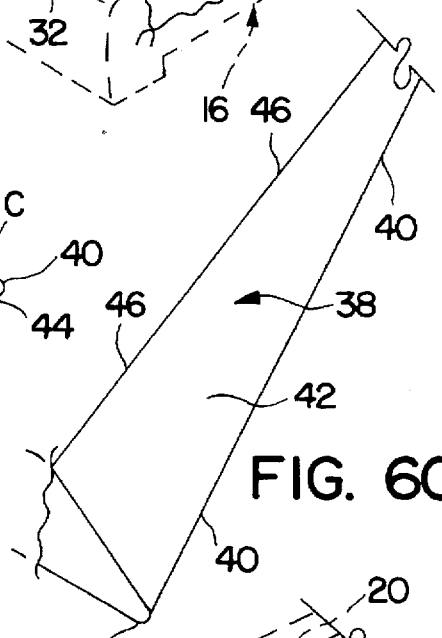
Figure 6A:
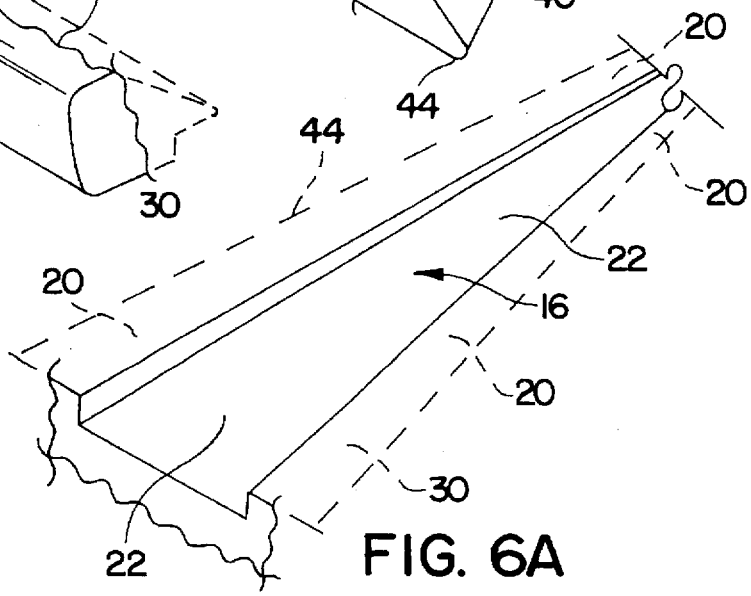

Referring to FIG. 1 a curtain support member, generally designated by the numeral, 10, is provided for supporting a curtain or drapery 12 and other curtain accessories 13 such as valances and/or sheers in a curved window archway, generally designated by the numeral 14. The curtain support member 10 is further illustrated in FIGS. 2, 3, 4, 5 and 6. The support member 10 includes a planar shaped base member, generally designated by the numeral 16. The base member 16 is provided with and a substantially flat lower surface 20 (FIG. 6-A). The lower surface 20 has an elongated rectangularly shaped channel 22 formed therein which extends the length of the lower surface. The curtain support member 10 is also provided with a first side wall or member, generally designated, by the numeral, 24 15 (FIG. 6-B). The first side member 24 is provided with first and second wall portions 26 and 28, respectively. The first wall portions 26 of the side member 24 are aligned with and coupled to adjacently aligned extending outermost portions 30 of the base member 16. The second wall portions 28 of the side member 24 are aligned with and coupled to the first wall portions 26 of the side member so that the second wall portions project therefrom in a vertically extending direction a first predetermined distance. The second wall portions 28 are also formed with a curved wall portion 32 which is formed at an uppermost portion of the second wall portions.

The support member 10 is also formed with a second side wall or member, generally designated, by the numeral, 38 having first and second wall portions 40 and 42, respectively (FIG. 6-C). The first wall portions 40 of the second side member 38 are aligned with and coupled to adjacently aligned extending outermost portions 44 of the base member 16. The second portions 42 of the side member 38 are aligned with and coupled to the first portions 40 of the side member so that the second portions project therefrom in an upward and diagonally extending direction a second predetermined distance. The second predetermined distance of the wall portion 42 is substantially the same as the first predetermined distance of the wall portion 28.

The curtain support member 10 is also formed with an upper member, generally designated, by the numeral, 46 (FIG. 6-D). The upper member 48 is formed with a diagonally descending wall portion 52. The upper member 48 is adjacently aligned with and coupled to the base member 16. The upper member 48 is also coupled at an outermost portion 54 thereof to the curved wall portion 32 of the first side member 24 and at an outermost portion 58 thereof to the second side member 38 at an outermost portion 46 so that the upper wall portion 52 is diagonally descending from the first side member to the second side member.

The base member 16, side members 24 and 38 and the upper member 48 are all formed of a flexible and readily bendable material, such as, for example, polystyrene. The flexible and bendable nature of the material in conjunction with the configuration of the support member 10 permits the support member to be readily bendable to conform to the shape and configuration of the curved window archway 14. The size of the support member 10 will depend on the size of the window and curtains to be hung. Of course the larger the window and curtains the larger of the support member 10.

The support member 10 can be coupled inside the curved window archway 14 to permit the curtain 12 to hang in an inside mounted configuration or can be coupled outside the curved window archway to permit the curtain to be hung in an outside mounted configuration. The shape of the support member 10 allows the support member to be used in either an inside or outside mounted configuration.

Figure 7:
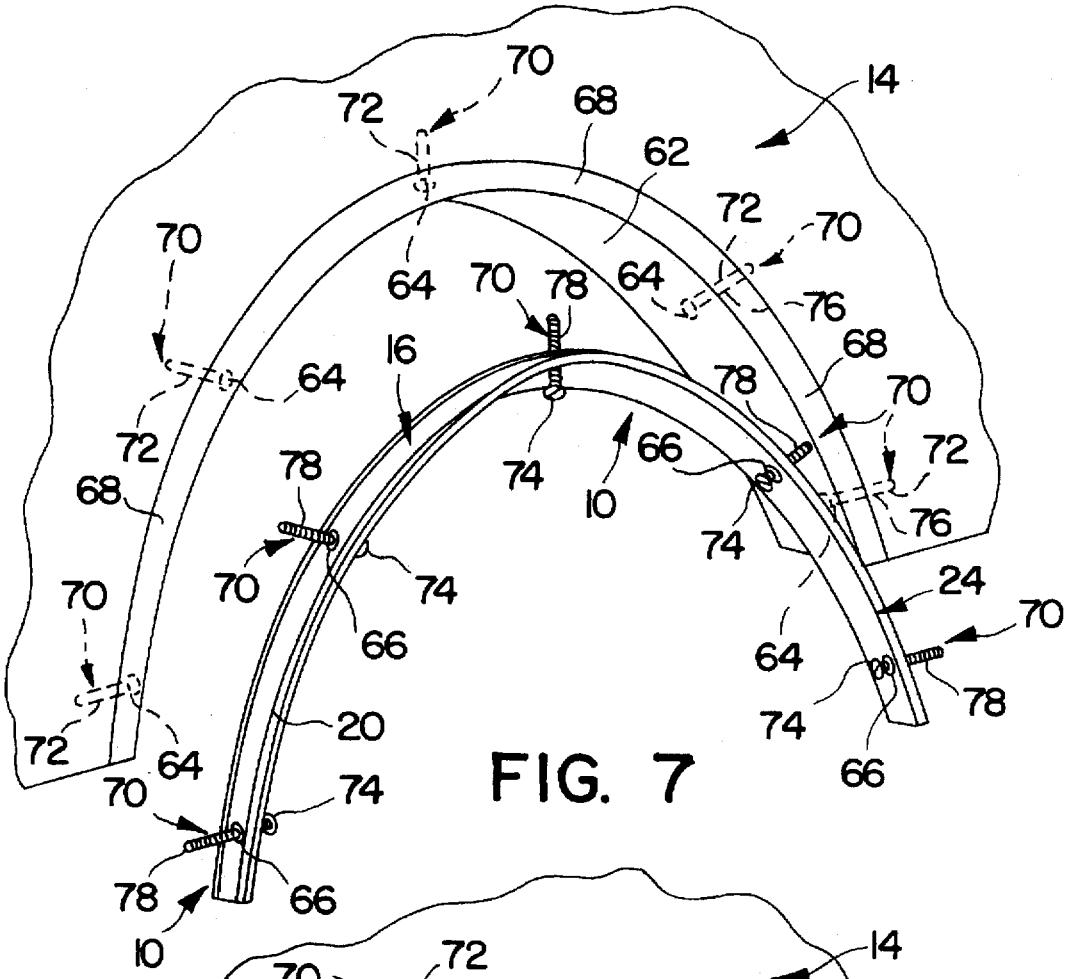
FIG. 7 is a perspective view of a curtain support member and mounting apparatus illustrated in conjunction with a curved window archway for facilitating the hanging of a curtain in an inside mounted configuration in accordance with the principles of this invention.
Figure 8:
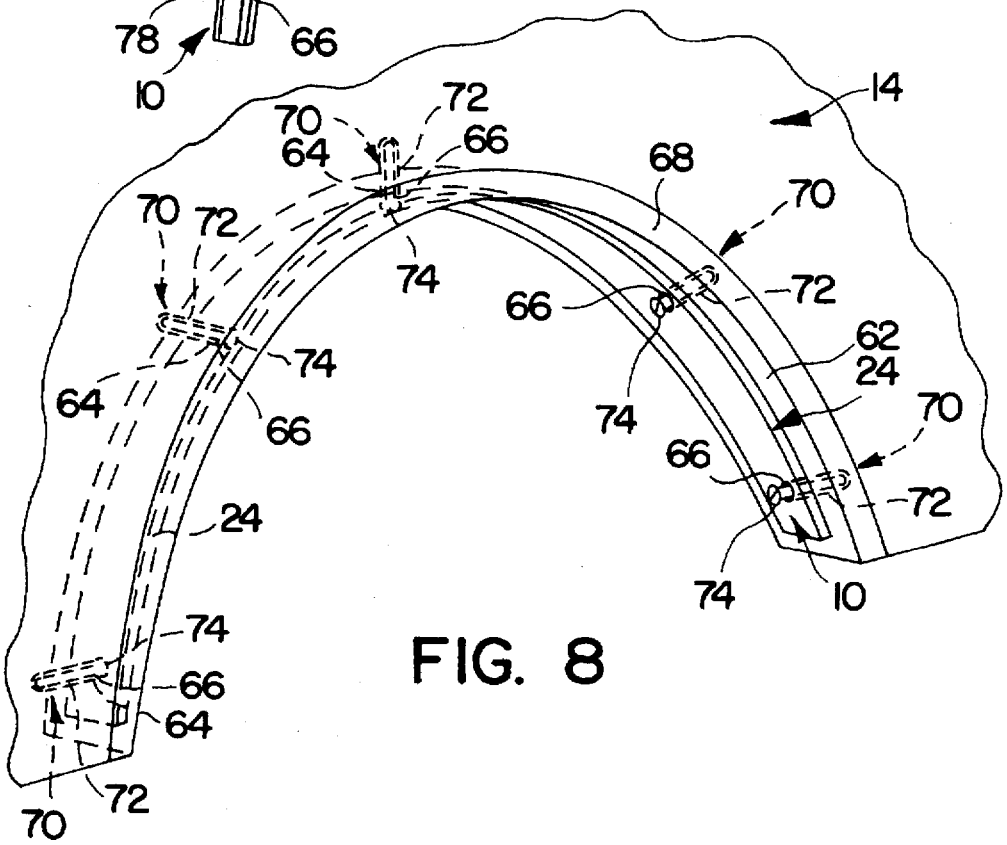
FIG. 8 is a perspective view of a curtain support member and mounting apparatus coupled to a curved window archway for illustrating a curtain hanging in an inside mounted configuration in accordance with the principles of this invention.

Referring to FIGS. 7 and 8, a support member 10 to be mounted so that a curtain 12 (FIG. 1) can be hung in an inside mounted configuration is illustrated. In this configuration a mounting apparatus, generally designated, by the numeral, 70 is provided. The mounting apparatus 70 may include, for example, coupling members such as hollow wall anchors 72 which are used in conjunction with a screw 74. The wall anchor 72 is provided with internal threads 76 (not shown) while the screw 74 is provided with external threads 78. When the screw 74 is screwed into the wall anchor 72 the threads 76 of the wall anchor and threads 78 of the screw interact with each other to facilitate coupling in a well known manner.

The hollow wall anchor 72 of the mounting apparatus 70 is securely mounted in the archway 14 on an inside archway support member 62 formed in the archway. The wall anchors 72 are mounted at predetermined spaced positions 64 on the archway support member 62. The screws 74 of the mounting apparatus are screwed through the curtain support member 10 at predetermined positions 66 thereon which are alignable with and correspond to adjacently aligned wall anchors 72 mounted in the archway 14.

In order to couple the curtain support member 10 in the archway 14, the curtain support member is aligned in the archway so that screws 74 can be screwed into adjacently aligned wall anchors 72. The curtain support member 10 when coupled in the archway 14 takes on the curvature of the archway and is positioned so that the substantially flat lower surface 20 of the base member 16 will engage the archway support member 62 and so that the side member 24 of the support member is aligned adjacent to an outside support surface 68 of the archway 14. In this curtain mounting configuration the curtain 12 (FIG. 1) is mounted inside the archway 14.

It should be understood that when mounting the curtain support member 10 in the archway 14 different kinds of mounting apparatuses 70 may be used depending on the material structure of the archway support member 62. For example, if the archway support member 62 is made of a material, such as, sheetrock, hollow wall anchors are preferable to secure the curtain support member 10 in the archway 14. If the archway support member 62 is made of wood then a mounting apparatus such as, a deck type screw may be used to secure the support member in the archway 14. If the archway support member 62 has portions thereof formed of sheetrock and other portions formed of wood then a combination of wall anchors and deck screws may be preferable in order to secure the support member 10 in the archway 14.

Figure 9:
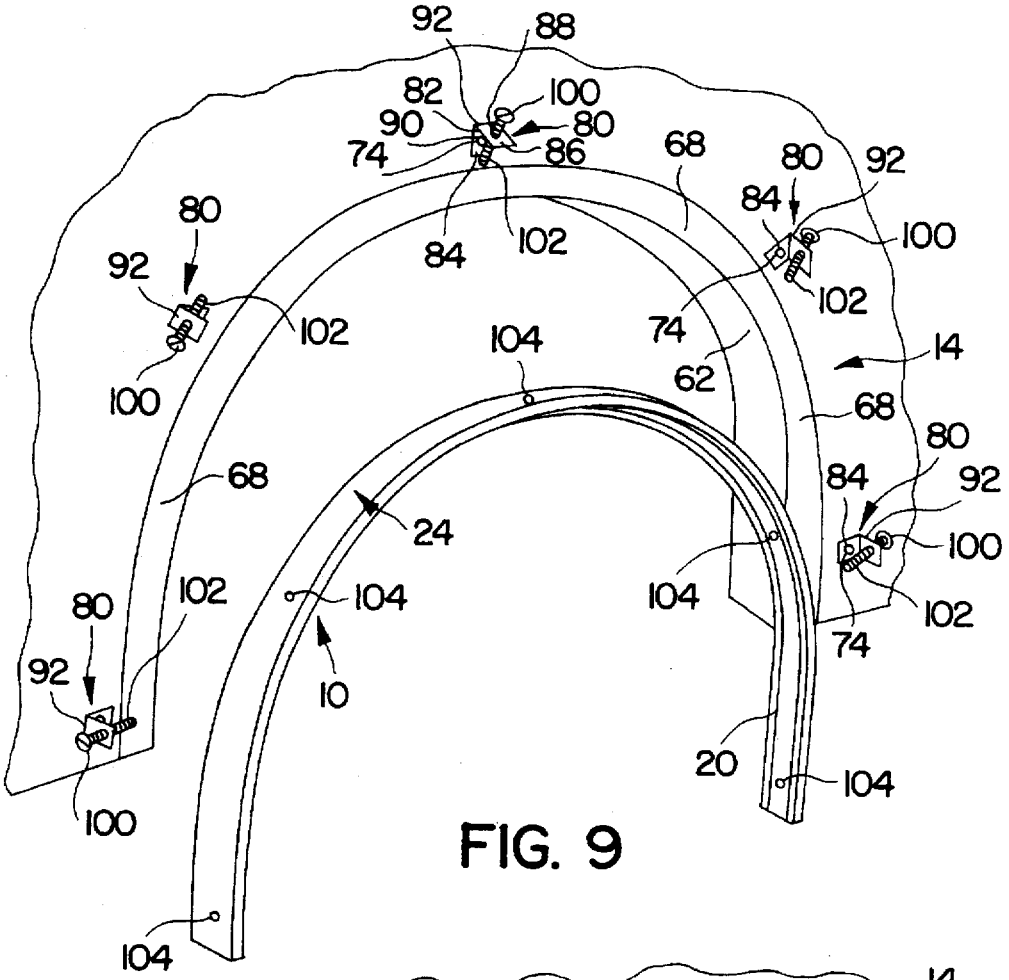
FIG. 9 is a perspective view of a curtain support member and mounting apparatus illustrated in conjunction with a curved window archway for facilitating the hanging of a curtain in an outside mounted configuration in accordance with the principles of this invention.
Figure 10:
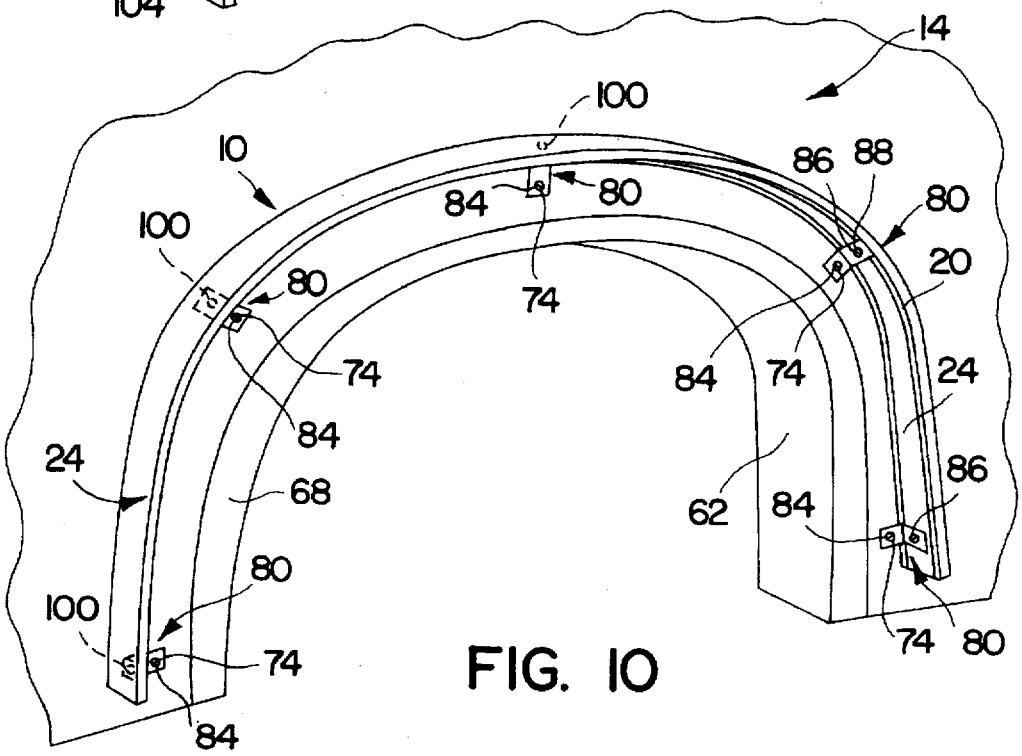
FIG. 10 is a perspective view of a curtain support member and mounting apparatus coupled to a curved window archway for illustrating a curtain hanging in an outside mounted configuration in accordance with the principles of this invention.

Referring to FIGS. 9 and 10 an outside curtain mounted configuration is illustrated. In this configuration a mounting apparatus, generally designated, by the numeral, 80 is provided to secure the curtain support member 10 above the outside archway support member 68 of the archway 14.

The mounting apparatus 80 is provided with a plurality of L-shaped brackets 82 having mounting arms 84 and 86, respectively. The mounting arms 84 and 86 of the bracket 82 are provided with apertures 88 and 90 respectively. The arms 84 of the brackets 82 can be mountable above the outside archway support member 68 of the archway 14 using hollow wall anchors 72 (not shown) and a screw 74 which extends through aperture 90 into the wall anchor. The brackets 82 are mounted above the outside archway support member 68 at predetermined spaced positions 92 above the outside archway support member.

The mounting apparatus 80 is also provided with a plurality of threaded bolts 100 and threaded nuts 102. The bolts 100 are provided to extend through apertures 88 in the mounting arms 86 and into apertures 104 formed in the curtain support member 10. As a result the nut 102 can be coupled to the bolts 100 when they are inserted in the apertures 88 to secure the curtain support member 10 on the archway 14. The support member 10 when coupled to the archway 14 is positioned so that the substantially flat lower surface 20 of the base member 16 rests on and engages the bracket arm 86 and so that the side member 24 of the support member is aligned with an outermost portion on the bracket arm 86. In this configuration the curtains 12 (FIG. 1) are mounted outside the archway 14.

It should be understood that the curtain 12 may be mounted on the curtain support member 10 using a curtain pocket as illustrated in FIG. 1 or with other fastening means, such as, for example, velcro. The manner in which the curtain 12 and/or curtain accessories 13 are mounted or coupled to the curtain support member 10 will depend on the structure of the curtain and accessories that have to be mounted thereto.

It should be understood that various changes and modifications can be made without departing from the spirit and scope of the invention as defined in the claims.

What is claimed:

1. A flexible curtain support member for supporting a curtain in a curved window archway including:

a base member having a substantially flat lower portion;

first side member coupled to an outermost portion of the base member to project vertically therefrom a first predetermined distance;

a second side member coupled to another outermost portion of the base member to project diagonally therefrom a second predetermined distance which is equal to the first predetermined distance; and an upper member coupled to the first side member adjacent to and in coupling engagement with the base member, to extend diagonally downwardly to couplingly engage the second side member.

2. A flexible curtain support member as defined in claim 1 wherein the base member, each side member and the upper member are formed of a flexible and readily bendable material.

3. A flexible curtain support member as defined in claim 2 wherein the base member, each side member and the upper member are formed of polystyrene.

4. A flexible curtain support member as defined in claim 3 wherein the lower portions of the base member has an elongated rectangularly shaped channel formed therein.

5. A flexible curtain support member as defined in claim 4 wherein the first side member includes:

first portions which couplingly engage adjacently aligned extending portions of the base member; and second portions which are coupled to the first portions to project vertically therefrom the first predetermined distance.

6. A flexible curtain support member defined in claim 3 wherein the second portions of the first side member is formed with a curvature therein on an uppermost portion thereof.

7. A flexible curtain support member as defined in claim 6 wherein the second side member includes:

first portions which couplingly engage adjacently aligned extending portions of the base member; and second portions which are coupled to the first portions to project diagonally therefrom the second predetermined distance.

8. A flexible curtain support member and mounting apparatus for supporting a curtain in a curved window archway including:

a base member having a substantially flat lower portion;

first side member coupled to an outermost portion of the base member so that first portions thereof engage adjacent extending portions of the base member and so that second portions thereof project vertically therefrom a first predetermined distance;

a second side member coupled to another outermost portion of the base member so that first portions thereof engage other adjacent extending portions of the base member and so that second portions thereof project diagonally therefrom a second predetermined distance which is equal to the first predetermined distance;

an upper member coupled to the first side member adjacent to and in coupling engagement with the base member, to extend diagonally downwardly to couplingly engage the second side member; and means for coupling the base member to selected predetermined portions of the archway so that the base member is coupled thereto in a predetermined manner and so that the support member conforms to the curved configuration of the archway.

9. A flexible curtain support member and mounting apparatus as defined in claim 8 wherein the coupling means includes:

a plurality of hollow wall anchors each having threads formed therein, and one of the plurality of wall anchors being mounted at a predetermined spaced position inside the archway; and a plurality of screws, having threads formed thereon, which couplingly interact with the threads in the hollow wall anchors, one of the plurality of screws being mounted at a predetermined spaced position in the support member adjacent to one of the plurality of wall anchors so that when the screws are coupled into the wall anchors the support member is coupled in the archway to conform with a curved configuration of the archway.

10. A flexible curtain support member and mounting apparatus as defined in claim 8 wherein the support member is coupled in the archway so that the substantially flat lower surface of the base member will engage an inside portion of the archway and so that the first side member is aligned adjacent to an outside portion of the archway.

11. A flexible support member and mounting apparatus as defined in claim 8 wherein the coupling means includes:

a plurality of mounting brackets, each one of the plurality of mounting brackets having first portions which are mounted at a predetermined spaced position outside the archway and second portions which are perpendicularly coupled to the first portions to projected outwardly from the archway a predetermined distance;

a plurality of bolts each having threads formed thereon and each one of the plurality of bolts being mounted at a predetermined position in the support member in alignment with and coupled to the second portion of an adjacently aligned mounting bracket; and a plurality of bolt securing members each having threads formed therein which couplingly interact with the threads on the bolts so that when the securing members are coupled to the bolts to secure the support member to the archway the support member is coupled outside the archway to conform with a curved configuration of the archway.

12. A flexible support member and mounting apparatus as defined in claim 11 wherein the mounting brackets are L-shaped brackets which include:

a first mounting arm couplable to predetermined spaced position outside the archway; and a second mounting arm perpendicularly coupled to the first mounting arm to project outwardly therefrom a predetermined distance above the archway.

13. A flexible curtain support member and mounting apparatus as defined in claim 12 wherein the support member is coupled to the archway so that the flat lower surface of the support member rests on and engages on adjacently aligned second mounting arm of the bracket and so that the first side member of the support member is aligned adjacent to outermost portions of the second mounting arm.

* * * * *